US008500431B2

(12) United States Patent
Reneker et al.

(10) Patent No.: US 8,500,431 B2
(45) Date of Patent: Aug. 6, 2013

(54) ELECTROSPINNING CONTROL FOR PRECISION ELECTROSPINNING OF POLYMER FIBERS

(75) Inventors: Darrell H. Reneker, Akron, OH (US); Tao Han, Shanghai (CN)

(73) Assignee: The University of Akron, Akron, OH (US)

( * ) Notice: Subject to any disclaimer, the term of this patent is extended or adjusted under 35 U.S.C. 154(b) by 819 days.

(21) Appl. No.: 12/516,651

(22) PCT Filed: Nov. 30, 2006

(86) PCT No.: PCT/US2006/046004
§ 371 (c)(1), (2), (4) Date: Mar. 10, 2010

(87) PCT Pub. No.: WO2008/066538
PCT Pub. Date: Jun. 5, 2008

(65) Prior Publication Data
US 2010/0215790 A1 Aug. 26, 2010

(51) Int. Cl.
*D01D 5/12* (2006.01)

(52) U.S. Cl.
USPC ..... 425/174.8 E; 425/376.1; 425/461

(58) Field of Classification Search
USPC ..... 425/174.8 E, 376.1, 461
See application file for complete search history.

(56) References Cited

U.S. PATENT DOCUMENTS

| | | | | |
|---|---|---|---|---|
| 5,347,847 | A | 9/1994 | Ogden | |
| 6,656,394 | B2 | 12/2003 | Kelly | |
| 8,052,407 | B2 * | 11/2011 | Andrady et al. | 425/72.2 |
| 2004/0061253 | A1 * | 4/2004 | Kleinmeyer et al. | 264/210.8 |
| 2006/0135020 | A1 | 6/2006 | Weinberg | |

* cited by examiner

*Primary Examiner* — Yogendra Gupta
*Assistant Examiner* — Joseph Leyson
(74) *Attorney, Agent, or Firm* — Renner Kenner Greive Bobak Taylor & Weber

(57) ABSTRACT

The present invention includes embodiments that generally relate to methods and devices for control of electrospinning processes. Some embodiments include constant current electrospinning jets. Other embodiments include pressure control using a system of valves in fluid communication with the electrospinning fluid. Still other embodiments include control of one or more physical parameters.

10 Claims, 4 Drawing Sheets

ELECTROSPINNING CONTROL FOR PRECISION ELECTROSPINNING OF POLYMER FIBERS

FIELD OF THE INVENTION

The present invention relates to apparatuses for electrospinning fibers and/or nanofibers, control methods for such apparatuses and methods for spinning fibers and/or nanofibers. In one embodiment, the fibers of the present invention are nanofibers formed from a spin fluid such as, polymers, polymer solutions, polymer solutions having colloidal suspensions of particles, cells, proteins, or the like.

BACKGROUND OF THE INVENTION

The technique of electrospinning, also known within the fiber forming industry as electrostatic spinning of liquids, and/or solutions capable of forming fibers, is well known and has been described in a number of patents as well as in the general literature.

The process of electrospinning generally involves the creation of an electrical field at the surface of a liquid. The resulting electrical forces create a jet of liquid which carries electrical charge. Thus, the liquid jets may be attracted to other electrically charged objects at a suitable electrical potential. As the jet of liquid elongates and travels, it hardens and dries. The hardening and drying of the elongated jet of liquid may be caused by cooling of the liquid, i.e., where the liquid is normally a solid at room temperature; evaporation of a solvent, for example, by dehydration, (physically induced hardening); or by a curing mechanism (chemically induced hardening). The produced fibers are collected on a suitably located, oppositely charged receiver and subsequently removed from it as needed, or directly applied to an oppositely charged generalized target area.

Besides providing variability as to the diameter of the fibers or the shape, thickness, or porosity of any non-woven mat produced therefrom, the ability to electrospin the fibers also allows for variability in the composition of the fibers, their density of deposition and their inherent strength. It is also possible to post-treat the non-woven mats formed via electrospinning with other materials to modify their properties. For example, one could increase the strength of the mat using an appropriate binder or increase water resistance by post-treating the mat with silicone or other water-resistant material.

SUMMARY OF THE INVENTION

The present invention generally relates to a devices and related methods for controlling electrospinning of fibers. Some embodiments relate to a pressure control apparatus and/or a method for using the same in connection with electrospinning.

In one embodiment, the present invention relates to a control system for creating and controlling electrospinning jets. The control system of the present invention permits one or more of the following to be obtained: (1) the production of fibers/nanofibers with improved uniformity in diameter; (2) more precise control of the fiber/nanofiber diameter; (3) better control of and/or the ability to prevent the onset of the electrically driven bending instability, as well as other production related instabilities; and (4) the ability to adjust and control the type of fiber/nanofiber produced.

Some embodiments relate to an electrospinning apparatus, comprising a spinneret for electrospinning in fluid communication with a supply of electrospinnable fluid. The embodiment also includes an electrical power supply in electrical communication with the electrospinnable fluid, wherein the electrical power supply is capable of supplying an output voltage. The embodiment also includes a resistor in electrical communication with the electrical power supply. The resistor receives the output voltage of the electrical power supply, and delivers a constant current to the electrospinnable fluid. Furthermore, the resistor is at least one order of magnitude greater in resistance than the electrospinnable fluid.

Some embodiments relate to an electrospinning apparatus, comprising a spinneret for electrospinning in fluid communication with a supply of electrospinnable fluid. According to this embodiment, the pressure of the electrospinnable fluid can be controlled by a system of valves. The embodiment further includes an electrical power supply in electrical communication with the electrospinnable fluid, wherein the means for applying a voltage is capable of supplying an output voltage. The embodiment still further includes a system of valves defining a Wheatstone bridge. Specifically, the Wheatstone bridge includes a first valve having a first port and a second port, wherein the first port is in fluid communication with an atmosphere, and the second is in parallel fluid communication with a second valve and a third valve. The second valve has two ports, wherein the first port is in parallel fluid communication with the first valve and the third valve, and the second port is in parallel fluid communication with a pumping means and a fourth valve. The third valve has two ports, wherein the first port is in parallel fluid communication with the first valve and the second valve, and the second port is in parallel fluid communication with the pumping means and a fifth valve. The fourth valve has two ports, wherein the first port is in parallel fluid communication with the pumping means and the second valve, and the second port is in parallel fluid communication with the electrospinnable fluid and the fifth valve. The fifth valve has two ports, wherein the first port is in parallel fluid communication with the pumping means and the third valve, and the second port is in parallel fluid communication with the electrospinnable fluid and the fourth valve. The pumping means has two ports, the first port being in parallel fluid communication with the second and fourth valves and the second port being in parallel fluid communication with the third and fifth valves, and wherein the pumping means draws from the first port and pumps fluid out of the second port;

wherein each of the first, second, third, fourth and fifth valves are at least capable of on and off fluid flow states, and wherein at least the second and third valves are additionally capable of continuous flow rate adjustment.

DESCRIPTION OF THE INVENTION

Figure 1:
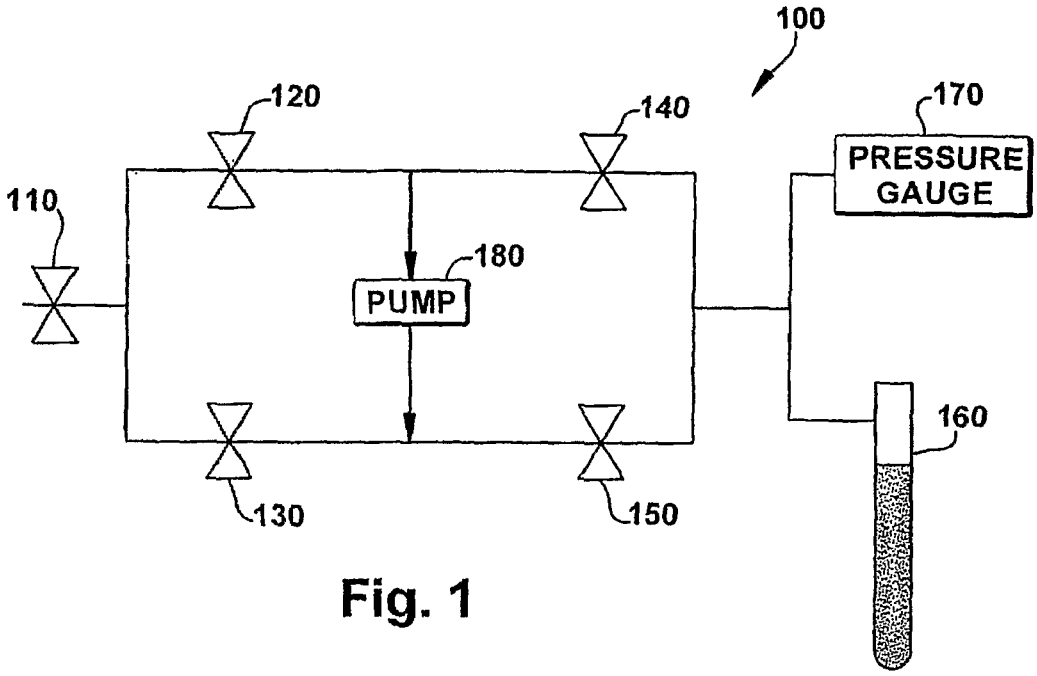
FIG. 1 is a schematic drawing of a pressure control means within the scope of the present invention, which is analogous to a Wheatstone bridge and capable of applying positive or negative pressure.

The present invention relates to apparatuses for electrospinning fibers and/or nanofibers, control methods for such apparatuses and methods for spinning fibers and/or nanofibers. In one embodiment, the fibers of the present invention are nanofibers formed from a spin fluid such as, polymers, polymer solutions, polymer solutions having colloidal suspensions of particles, cells, proteins, or the like. According to some embodiments, the polymer jet is controlled by applying a defined pressure to a spin fluid at the orifice of a spinneret. In other embodiments, the spin fluid can form a film on an inside surface of a spinneret orifice, and a gas jet passing over the spin fluid can impart momentum thereto, resulting in a fiber-spinning action. In still another embodiment, the present invention can include a constant current power supply.

As used herein nanofibers are fibers having an average diameter in the range of about 1 nanometer to about 25,000 nanometers (25 microns). In another embodiment, the nanofibers of the present invention are fibers having an average diameter in the range of about 1 nanometer to about 10,000 nanometers, or about 1 nanometer to about 5,000 nanometers, or about 3 nanometers to about 3,000 nanometers, or about 7 nanometers to about 1,000 nanometers, or even about 10 nanometers to about 500 nanometers. In another embodiment, the nanofibers of the present invention are fibers having an average diameter of less than 25,000 nanometers, or less than 10,000 nanometers, or even less than 5,000 nanometers. In still another embodiment, the nanofibers of the present invention are fibers having an average diameter of less than 3,000 nanometers, or less than about 1,000 nanometers, or even less than about 500 nanometers. Additionally, it should be noted that here, as well as elsewhere in the text, ranges may be combined.

The length of the fibers formed via the present invention is not important. Fibers within the scope of the present invention can be continuous or discontinuous. Furthermore, fibers formed via the present invention can be any desired length. In another embodiment, the length of the fibers/nanofibers produced herein can vary widely, and includes fibers that are as short as about 0.0001 mm up to those fibers that are many kilometers in length. In still another embodiment, the fibers can have a length from about 0.0001 mm to about 1 km, from about 0.001 mm to about 500 m, from about 0.01 mm to about 50 m, from about 0.1 mm to about 25 m, from about 1 mm to about 15 m, from about 1 cm to about 10 m, from about 25 cm to about 5 m, from about 50 cm to about 2.5 m, or even from about 75 cm to about 1 m.

Improved Control of Electrospinning Jets

Electrospinning is usually accomplished by applying and controlling the electrical potential at the surface of a liquid which is constrained by surface tension. In the present invention, the primary control of the jet is accomplished by control of the electrical current carried by the jet.

The usual method of electrospinning utilizes a constant (but adjustable) potential applied to the jet. The operator adjusts the potential until a steady jet is achieved. The operator may choose a flow rate (e.g., with a syringe pump or a pressure inside the fluid at the tip, for example, by varying the weight of the column of liquid in the pipette). Uncontrolled variations in the shape of the liquid surface near the orifice can produce unwanted variations in the diameter of the jet as a function of time, leading to variations of the diameter of the resulting polymer nanofiber. Such variations occur when the constant flow in is different than the rate at which the electrical forces cause the jet to flow. A droplet of oscillating volume, and oscillations in the flow rate of the jet can occur. Shape changes of the fluid surface also lead to variations in amount and distribution of the electrical charge per unit area on the surface of the jet.

According to one embodiment of the present invention, it may be desirable to maintain appropriate levels of control over one or more of the following parameters: the pressure at the surface of the spin fluid, the diameter and shape of the spinneret orifice, and the cross sectional area of the jet at the orifice.

The pressure at the surface of the fluid, particularly at the orifice of the spinneret tip, can be controlled. This may be accomplished by control of other physical parameters such as gas pressure applied to the jet, and by controlling the hydrostatic head pressure of the jet. As the flow of the jet is restricted by viscous flow through a narrow channel, and the control pressure is increased to maintain a desired flow rate, the system goes from a constant pressure feed to a constant flow rate feed. Adjustment of the viscous flow may be used to control the process within some useful operating ranges.

The maintenance of a stable jet in the presence of one or more sources of variability can be promoted by the application of a constant current carried by the jet. For example, if the flow rate of the jet decreases or stops, a constant current source will cause the electrical potential to increase with time, which will tend to cause the jet to flow at a rate that maintains the current. Conversely, if the flow rate increases, the electrical potential at the orifice will change in a way to cause the set current to be maintained.

Jets with small diameters, which are needed for the manufacture of thin nanofibers, are most significantly affected by changes in the ancillary parameters listed above, so a constant current source is helpful for producing thin jets which are stable, to a useful degree, at potentials at which a constant potential driven jet would not start, or if started, would die in the presence of a small perturbation.

Constant Current

According to some embodiments, control of an electrospun jet is accomplished by maintaining a constant electrical current carried by the jet. "Constant current" as used here includes the magnitude of the current, and that the current does not change even if the resistance of the jet changes.

In one embodiment, a simple constant current supply can be formed by applying a high voltage (e.g. 0.1 to 500 KV) to a resistor having a resistance that is much larger than that of the flowing jet, which is about 10 MΩ. In some embodiments the resistor may be from about 1 to $10^8$ Mega-ohm, from about 1 to $10^7$ Mega-ohm, or even from about 1 to $10^6$ Mega-ohm. In such a circuit, the resistance of the constant current is approximately equal to the voltage of the power supply divided by the value of the large resistor. In one embodiment, constant currents in the range from about 1 nanoampere to about 10 nanoamperes can be utilized to yield small, well controlled jets. It should be noted that this range is not meant to be limiting. Other acceptable ranges include from about 1 to 100 nanoamperes, from about 1 to 20 nanoamperes, from about 20 to 30 nanoamperes, from about 30 to 40 nanoamperes, from about 40 to 50 nanoamperes, from about 50 to 60 nanoamperes, from about 60 to 70 nanoamperes, from about 70 to 80 nanoamperes, from about 80 to 90 nanoamperes, and even from about 90 to 100 nanoamperes. Here, as elsewhere in the specification and claims, ranges may be combined.

Other ways to obtain a constant current are within the scope of the present invention. Some additional ways to obtain a constant current will be discussed below. However, the present invention is not limited to solely the means for obtaining a constant current disclosed herein. Rather, any suitable method of obtaining a constant current can be utilized in conjunction with the present invention.

While not wishing to be bound to any one theory, the stability of the electrospinning jet can be increased via the use of a constant current because, for example, if the flow rate of the electrospinning jet increases or decreases, a constant current source will cause the electrical potential, to correspondingly decrease or increase with time. This tends to cause the electrospinning jet to flow at a constant rate. Thus, the stability of the electrospinning jet is improved and the uniformity of the fiber product is enhanced.

Another aspect of the present invention permits one to control the shape of the electrospinning jet in the vicinity of the region on a liquid surface from which the electrically charged jet emerges. This region is sometimes referred to as the base of the jet. The pressure on the fluid surface is controlled to provide preferred shapes of the liquid surface in this region.

A constant current source forces a selected current (e.g., a current of a few amperes) through an external load, even if the voltage across the external load increases or decreases. The volt ampere/curve of the load may be complex. The load may contain inductive or capacitive elements. Such elements may cause transient departures from the time averaged "constant current".

In one embodiment, a practical constant current source can be realized by connecting a very high electrical potential through a very high resistor to an external load. In another embodiment, a practical constant current source can be realized by electronic circuits which monitor the current flowing through the load and adjusts the values of the potential source, or the internal resistance, or both so that the monitored current is constant in time.

In electrospinning the current/voltage relation of the jet is complex, and affected by the flow properties of the fluid in the apparatus. The effective voltage is high when a Taylor cone forms on the surface of a droplet, but before the jet ejected. After the jet forms the voltage across the jet drops quickly and resistance of the jet changes as the selected value of the current is increased. The slope and shape of the volt-ampere curve after the jet is established are affected by the flow properties of the fluid in the apparatus.

Reactive elements, typically capacitance or inductance, may also arise in other ways, e.g. fluid mechanics or elasticity of rubber, i.e. entropy elasticity. These affect the system response as a function of time and may produce a variety of effects, including switching and oscillatory phenomena which are also useful and are a part of this invention.

The constant current electrospinning of the present invention provides access to, and means for, the adjustment of pressure inside a fluid at a spinneret orifice. It provide useful alternatives particularly for the production of jets that taper to nanofiber diameters and dry before electrically driven bending instabilities occur. This can be important in creating a dry nanofiber that can be directed to a desired position on a collector (parallel lines, mesh, grid, e.g. for writing or other such capabilities), and for control of buckling phenomena often observed when the momentum of a jet is dissipated by its arrival at a collection surface.

In still another embodiment, an electromechanical device such as a Van de Graff potential generator also can be used as an effective constant current source. A Van de Graff generator is usually designed with a very high load resistor and a significant capacitance in parallel.

Still another embodiment includes the use of high resistivity polymeric compositions to make inexpensive, durable and chemically inert resistors in conjunction with a high voltage supply to create a constant current. For example, in one embodiment such a resistor can comprise one or more elastomers compounded with graphite particles. Other conductive particles can include copper, silver, aluminum, gold, platinum, tin, lead, or iron. In another embodiment an appropriate resistor can comprise a silicate glass microscope slide. One power supply and many such resistors can be used to supply constant currents to many jets. The cost of such resistors, fabricated by polymer processing techniques, could be low enough to supply hundreds of jets from a single, inexpensive high voltage power supply. The maximum current available from the power supply can be limited to a value that minimizes the chances of harmful electrical shocks. In another embodiment, each spinneret and/or each spinneret orifice has its own resistor for supplying constant current.

Pressure Control

One embodiment includes the adjustment of pressure of the spin fluid inside the cone shaped region of the drop (i.e. the drop on a spinneret from which a jet forms). The pressure inside the fluid must be controlled in a range $\Delta p$ from:

$$P+\Delta p \text{ to } P-\Delta p$$

where P is the pressure that would result in the formation of a flat fluid surface across the orifice and $\Delta p$ is the pressure change required to change the flat surface to a hemispherical surface.

The present invention also relates to a pressure control means, which is capable of applying a positive, negative or no pressure to the spin fluid in a spinneret. In general such a pressure control device can be used in connection with a spinneret so that a spin fluid at the tip of the spinneret forms either a meniscus-shaped (concave), a flat end or a beaded end (convex). Pressure can be generated and controlled by any appropriate means. For example, according to one embodiment pressure can be generated with a syringe pump, and controlled with a plurality of valves and vents. Other appropriate pumping means include, without limitation, a gear pump, syringe pump, turbine pump, rotating fan pump, or peristaltic pump.

Figure 5:
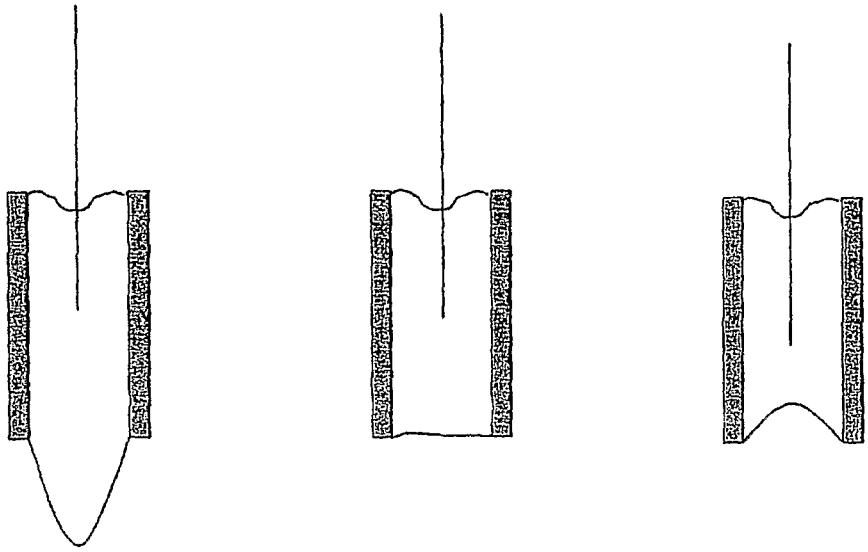
FIG. 5 is a set of three drawings showing the effect of applied pressure on the fluid drop at the tip of a spinneret.

In one embodiment, the morphology of the polymer at the tip of the spinneret is controlled by applying pressure. The pressure can be sensed in the gas lines leading to the spinneret, and the shape of the spin fluid at the tip of the spinneret can be monitored visually and/or optically. According to one optical method, a collimated light such as a laser is directed to the tip of the spinneret, which results in an interference pattern. Reflected light having this interference pattern can be detected by means known to those in the art. Furthermore, the specific analytical signal depends on, and can be correlated to, the shape of the spin fluid at the tip. FIG. 5 shows three general shapes that a drop at a spinneret tip can form. These shapes are pressure dependent. Generally, the concave shape occurs when the applied pressure is negative, and the convex shape occurs when the applied pressure is positive.

Figure 3:
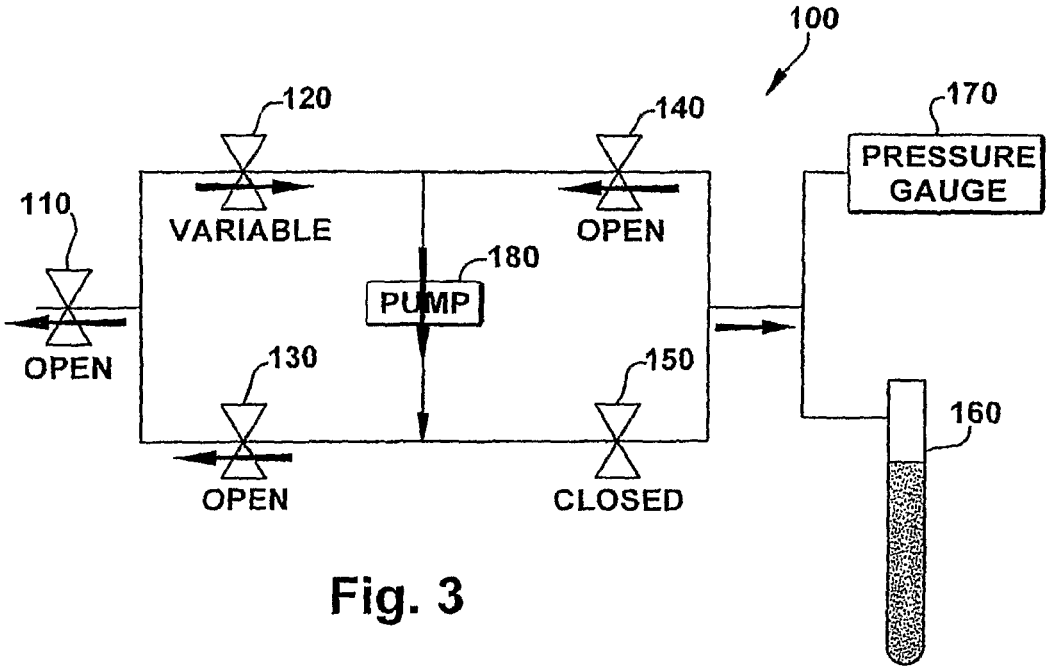
FIG. 3 is a is a schematic diagram similar to that of FIG. 2, but the system is applying a negative pressure.
Figure 4:
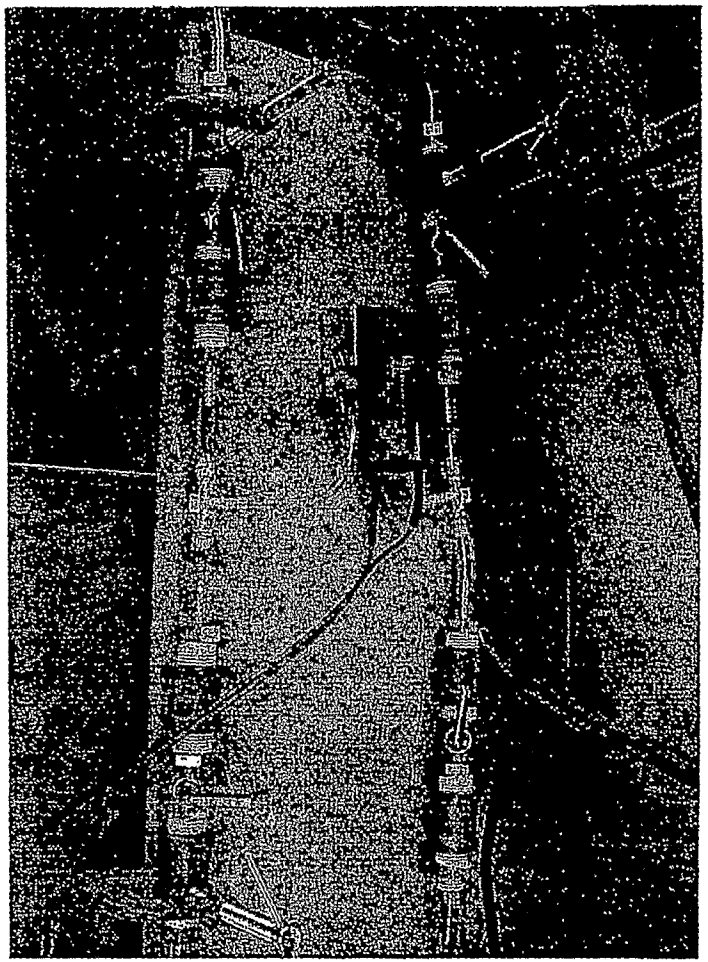
FIG. 4 is a photograph showing one specific embodiment of the pressure control system.

Very small changes in pressure (e.g. about 1-2000 Pa) can make significant changes in the shape of the surface. A system of valves enables one to provide stable, incremental control of the pressure inside the drop in a range from slightly above to slightly below atmospheric pressure. In one embodiment the system of valves is analogous to the arrangement of resistors in a Wheatstone bridge circuit. An example is shown diagrammatically in FIGS. 1 through 3, and an example embodiment is shown in the photograph in FIG. 4. In an alternative embodiment a computer-controlled syringe pump can be used to control pressure.

According to the embodiment shown a pressure control device can be formed from a system of five valves defining a fluidic Wheatstone bridge. According to this embodiment, valves 110, 120, 130, 140, and 150 are all open. The pump 180 is on and pumps fluid from valves 120 and 140 to valves 130 and 150. Valve 110 is in fluid communication with the atmosphere, and valves 140 and 150 are in fluid communication with the electrospinning solution 160, and optionally with a pressure gauge 170. The valves may be flow-adjusted thereby resulting in very fine control of the pressure applied to the electrospinning fluid.

As shown in FIG. 5, when a positive pressure is applied to the spin fluid, the pressure at the orifice is equal to the hydrostatic head pressure plus the applied pressure, and a beaded i.e. convex surface results. When the applied pressure is negative and approximately equal to the hydrostatic head pressure a flat surface results. And, when the applied pressure is somewhat greater than the hydrostatic head pressure, a concave surface results wherein the fluid contacts the rim of the orifice at an acute angle.

Figure 2:
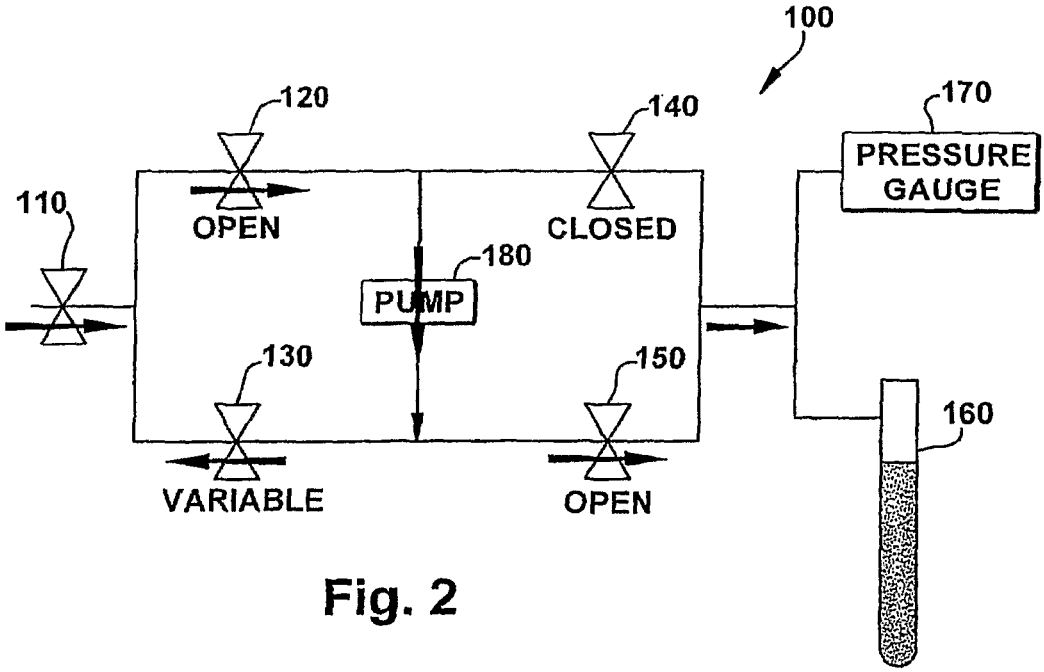
FIG. 2 is a schematic diagram of the pressure control means of FIG. 1, wherein valve condition (open/closed) and fluid flow directions are indicated, and which is in a positive pressure arrangement.

In a related embodiment shown in FIG. 2, valve 140 is closed and 130 is variably adjusted. According to this embodiment, a positive pressure is applied to the electrospinning fluid, and the pressure can be adjusted by adjusting the valve 130. Similarly, a negative pressure can be applied to the electrospinning fluid (FIG. 3) by closing valve 150 and variably adjusting valve 120. In this embodiment, an adjustable negative pressure can be applied to the electrospinning fluid.

According to one embodiment, an apparatus within the scope of the present invention is capable of providing pressures from about $-10^4$ to $+10^4$ N/m$^2$. Other embodiments are capable of providing pressures from about $-10$ to $+10$ N/m$^2$, from about $-10^2$ to $+10^2$ N/m$^2$, from about $-10^3$ to $+10^3$ N/m$^2$, from about $-10^5$ to $+10^5$ N/m$^2$, or even from about $-10^5$ to $+10^5$ N/m$^2$. According to some embodiments, pressure can be changed and/or adjusted in increments of about 0.001 N/m$^2$, 0.01 N/m$^2$, 0.1 N/m$^2$, 1 N/m$^2$, 10 N/m$^2$, or even about 100 N/m$^2$.

Precision Electrospinning Tools

In one embodiment, the present invention permits one to adjust the pressure to control the shape of the fluid interface as it leaves the orifice of the tip. The shape can be controlled to have a pendant droplet, a nearly flat interface, or a concave shape which extends into the fluid carrying channel of the tip. At a constant voltage, the effect of changing the shape of the surface makes dramatic changes in the behavior of the jet.

Drying causes the formation of a skin on a pendant drop. The skin can be controlled by adjusting the flow rate of fluid and caused to dissolve, or grow in length by adjusting the partial pressure of solvent inn the surrounding gas phase. Probably tubes with diameters ranging from about a few millimeters to about a few tens of microns can be formed (i.e., made to grow). For some polymers the tubes can be stabilized by chemical crosslinking, to permanently alter the diameter and shape of the orifice. It may be possible to make longer tubes with small diameters and thin walls by control of the solidification of the surface layer. This is the phenomena which underlie the formation of ribbons. The scale is appropriate for the manufacture of artificial capillaries, or slightly larger blood vessels, for example.

Additional Embodiments

Spinneret Orifice

Another embodiment of the present invention includes the use of elastomeric materials or adjustable valve-like openings to control the shape and area of the orifice through which fluid enters the drop. Some embodiments can include orifice shapes such as circles, straight slits, meniscus-shaped slits or annular slits. These examples are not limiting and any desired shape can be used. A small orifice combined with a high pressure in the fluid tends to produce a flow into the base of the jet that is faster than the flow of the jet. This results in changes in the shape of the base, and may lead to either useful or unwanted variations in the flow rate and the diameter of the jet.

According to some embodiments, the diameter and shape of the orifice can be kept fixed. In other embodiments variation of diameter and/or shape may be useful. The shape and size of the surface of the jet introduce a reservoir-like parameter, and provide a variable interaction between the size of the jet and the flow rate of material leaving the orifice.

According to other embodiments, the cross sectional area of the jet at the orifice and the cross sectional shape of the jet can also be used to control certain aspects of the electrospinning process. The curvature at the perimeter of a thin cross sectional slice of the jet may vary if the shape of the slice is circular, slit-like, star-like, or petal-like. The shape of the jet or droplet from which the jet issues may change due to accumulation of solid material on the jet orifice, changes of potentials on nearby electrodes, or changes in the electrical resistivity of solid material near the orifice.

Adjustments to the diameter and shape of the tip orifice may also be made. In one instance the tip can be changed, by some mechanical means. For example, the orifice might be elastomeric and capable of being opened, closed, or distorted by mechanical forces applied to the elastomeric material.

Either the pressure inside the fluid or the flow rate through the orifice may be controlled, but not both at the same time, unless some other parameter, such as the area and shape of the orifice are adjusted in compensating ways. These examples are not limiting.

The shape of the jet may also be controlled by adjustment of the size and shape of the orifice from which the fluid issues, or the size and shape of the wetting line at which the jet is attached to the orifice which supplies the fluid.

Controlled Drying; Entrainment in Solvent-Gas Stream

Jets may be collected, not only by attachment to a surface, but also by entrainment in a stream of gas. The gas stream can contain no solvent molecules for the most rapid drying, or can contain a defined concentration of solvent molecules to control the rate at which the jet dries. According to some embodiments this may keep the jet soft and able to conglutinate at crossing points.

Still another embodiment includes the collection of the jet or the resulting nanofiber by entrainment in a stream of gas. The presence of solvent vapor in the gas stream can slow the loss of solvent, and give a jet more opportunity to elongate under the influence of charge on the jet. Conversely, larger fibers can be made by more rapid drying.

Gas Streams with Air-Borne Ions

The stream of gas may also contain airborne ions which may either increase the charge on the jet to make it elongate in flight, or to change its direction in a transverse electric field, or in a very high magnetic field. Conversely, the stream of gas may contain charges which cancel the charge on the jet and favor the development of a capillary instability which leads to the formation of beads on the jet, or to the formation of solid particles of polymers in the case of low molecular weight polymers. Drying and handling the jet in an air stream also provides useful options for collecting or placing the electrospun fiber.

According to still another embodiment includes the use of gas borne ions (created deliberately, for example, in a corona discharge) to alter the electrical charge carried on the jet. More charge will increase the forces that produce elongation. Neutralization of the charge will encourage the formation of beads which tend to have higher concentrations of low molecular weight substances that remain in solution and are then forced into the beads as capillary forces cause the beads to form.

Thin Jets; Added Stability

In one embodiment, an electrospinning apparatus according to the present invention utilizes thin electrospinning jets. Thin jets can produce thin, dry nanofibers with a minimum and/or controlled amount of electrically-induced coiling. These thin jets are generally more stable than the jets typically used in previous electrospinning apparatuses, where the electrical potential (voltage) applied to the jet is kept constant.

According to still another embodiment includes guiding stable and controllable jets, which can be produced via the methods disclosed herein, into arrays and structures with electric fields that vary in time and direction, and can be used along with the commonly observed proclivities of the jets to coil, buckle, branch, etc. to made complicated reproducible fiber structures.

Oscillatory Modes

Oscillatory modes of jet flow can also be maintained with a fixed current if the response of the flow rate to changes in the electrical potential at the orifice is not instantaneous. The transition between steady flow and oscillatory flow is a familiar problem in electrical engineering of systems with positive or negative feedback and non-linear volt-ampere characteristics. Control of delayed response can be utilized to create fibers with time varying diameters in a controlled way, even to the point of making discontinuous jets and fibers. Discontinuous fibers contain information of about the starting and stopping of jets which is usually not available. So, such observations reveal useful process control information that is not readily available from continuous jets.

In one embodiment, an oscillatory flow can be made to occur with the constant current apparatus; if the flow rate of the fluid to the orifice is restricted by viscosity to a value lower than the rate at which fluid can leave the orifice as an electrified jet. This condition may be achieved at higher settings of constant current.

In one instance, the sequence is as follows. The jet flow depletes the supply of fluid near the orifice, changing the shape of the fluid surface there, and causing the jet to become smaller and stop. The voltage increases, then the flow through the restriction gradually builds up along with the potential at this orifice, and a new jet is initiated. The process then repeats. Jet oscillations are sometimes seen at the tip of a large Taylor cone.

As discussed above, one advantage of some embodiments is to enable the production of fibers/nanofibers with controlled periodic variations along their lengths.

Although the invention has been described in detail with particular reference to certain embodiments detailed herein, other embodiments can achieve the same results. Variations and modifications of the present invention will be obvious to those skilled in the art and the present invention is intended to cover all such modifications and equivalents.

We claim:

1. An electrospinning apparatus, comprising:

a spinneret for electrospinning in fluid communication with a supply of electrospinnable fluid, the pressure of the electrospinnable fluid being controlled by a system of valves;

an electrical power supply in electrical communication with the electrospinnable fluid, wherein the electrical power supply is capable of supplying an output voltage;

a first valve having a first port and a second port, wherein the first port is in fluid communication with an atmosphere, and the second is in parallel fluid communication with a second valve and a third valve;

the second valve having two ports, wherein the first port is in parallel fluid communication with the first valve and the third valve, and the second port is in parallel fluid communication with a pumping means and a fourth valve;

the third valve having two ports, wherein the first port is in parallel fluid communication with the first valve and the second valve, and the second port is in parallel fluid communication with the pumping means and a fifth valve;

the fourth valve having two ports, wherein the first port is in parallel fluid communication with the pumping means and the second valve, and the second port is in parallel fluid communication with the electrospinnable fluid and the fifth valve;

the fifth valve having two ports, wherein the first port is in parallel fluid communication with the pumping means and the third valve, and the second port is in parallel fluid communication with the electrospinnable fluid and the fourth valve;

and the pumping means having two ports, the first port being in parallel fluid communication with the second and fourth valves and the second port being in parallel fluid communication with the third and fifth valves, and wherein the pumping means draws from the first port and pumps fluid out of the second port;

wherein each of the first, second, third, fourth and fifth valves are at least capable of on and off fluid flow states, and wherein at least the second and third valves are additionally capable of continuous flow rate adjustment.

2. The apparatus of claim 1, wherein the means for applying a voltage is capable of applying from 0.1 to 500 KV.

3. The apparatus of claim 1, wherein the pumping means is selected from one or more of gear pump, syringe pump, turbine pump, rotating fan pump, or Peristaltic pump.

4. The apparatus of claim 1, wherein each of the valves are capable of reversible fluid flow.

5. The apparatus of claim 1, wherein the fourth and fifth valves and the electrospinning apparatus are each additionally in parallel communication with a common pressure gauge.

6. The apparatus of claim 1, wherein the apparatus is capable of providing pressures from $-10^4$ to $+10^4$ N/m$^2$.

7. The apparatus of claim 1, wherein the apparatus is capable of adjusting pressure in 1 N/m$^2$ intervals.

8. The apparatus of claim 1, wherein the apparatus is capable of forming a gas-liquid interface wherein, the liquid forms a concave surface geometry.

9. The apparatus of claim 1, wherein the apparatus is capable of forming a gas-liquid interface wherein, the liquid forms a convex surface geometry.

10. The apparatus of claim 1, wherein the apparatus is capable of forming a gas-liquid interface wherein, the liquid forms a flat surface geometry.

* * * * *